US005571538A

United States Patent [19]

Cloud

[11] Patent Number: 5,571,538

[45] Date of Patent: Nov. 5, 1996

[54] GROUT SEALANT APPLICATOR

[76] Inventor: Donald E. Cloud, 3436 Highlands Bridge Rd., Sarasota, Fla. 34235

[21] Appl. No.: 503,378

[22] Filed: Jul. 17, 1995

[51] Int. Cl.$^6$ ..... B05C 1/16

[52] U.S. Cl. ..... 425/87; 401/137; 401/192

[58] Field of Search ..... 425/87, 458; 401/137, 401/138, 140, 192; 222/191, 566; 404/107, 111

[56] References Cited

U.S. PATENT DOCUMENTS

| | | | |
|---|---|---|---|
| 1,661,599 | 3/1928 | Cynova | 425/458 |
| 1,893,082 | 1/1933 | Howard | 404/107 |
| 1,932,001 | 10/1933 | Tarrant | 404/107 |
| 1,935,639 | 11/1933 | Keeshan | 401/192 |
| 2,659,918 | 11/1953 | Stoner | 401/192 |
| 2,723,411 | 11/1955 | Ellis | 401/192 |
| 2,855,620 | 10/1958 | Jones | 401/192 |
| 4,199,311 | 4/1980 | Ferris et al. | 425/87 |
| 4,432,715 | 2/1984 | Ghim | 425/87 |
| 4,695,185 | 9/1987 | Spells et al. | 425/87 |

FOREIGN PATENT DOCUMENTS

| | | | |
|---|---|---|---|
| 1464860 | 1/1967 | France | 404/107 |

OTHER PUBLICATIONS

Modern Plastics, vol. 33, No. 10, p. 196, "Butyrate Handle for Automatic Waxer". Jun. 1956.

*Primary Examiner*—Robert Davis

*Attorney, Agent, or Firm*—Russell & Russell; Douglas D. Russell

[57] ABSTRACT

A grout sealant applicator for holding a quantity of low viscosity liquid grout sealant and for controlling the uniform rate of dispensing the sealant into the groove of the grout of a tile floor. The applicator includes an elongated tubular handle which is fillable from one end with sealant and a sealant flow regulating valve at the other end of the handle. A nozzle is connected to the valve so that sealant flows by gravity feed from the handle when positioned somewhat uprightly, through the valve and a small longitudinal bore within the nozzle. The handle is of sufficient length to hold a large quantity of sealant to minimize refills and to permit the hand grasping and manipulating of the upper end thereof to cause the distal end of the nozzle to slide within the grooves formed by the grout and without the need for stooping or kneeling. Sealant flow regulation is also controlled by providing a removable end cap at the upper in use end of the handle having a vent hole which may be closed by a finger or thumb of the user to prevent air from entering the handle. A tubular handle extension, transparency of the handle for sealant level viewing, and a shaped nozzle distal end conforming generally to the concave grout are also provided.

12 Claims, 2 Drawing Sheets

GROUT SEALANT APPLICATOR

BACKGROUND OF THE INVENTION

1. Field of Invention

This invention relates generally to applicators for tile floor grout sealant and more particularly to a gravity fed hand held grout sealant applicator for dispensing a liquid sealant atop the grout of a tile floor.

2. Prior Art

Ceramic tile floors and the like are very popular in both homes and in commercial establishments, especially useful for heavy traffic patterns to add a substantial wear resistance factor to the floor covering. Such tile floors are composed of individual tile elements adhered to a subfloor surface in spaced edge-to-edge fashion to define a desired tile pattern. After the tile elements have been secured to the underlying subsurface, a hardenable grout material such as cement is applied between the tiles for both decorative effect and for providing a finished appearance of the tile floor for cleaning purposes. A uniform groove is formed by a suitable finishing tool to define an exposed grout surface, typically a radius.

However, after use and repeated cleaning of the tile floor, the grout, if not properly sealed, accumulates residue within its relatively porous composition and becomes unsightly. To prevent accelerated accumulation and visual deterioration and discoloration of the grout, the application of a low viscosity grout sealant is well known. When properly applied in sufficient quantity, the grout sealant will prevent any further floor cleaning residue and dirt accumulation until otherwise worn or washed away.

One conventional means for applying grout sealant is with a suitable brush of either bristle or foam composition. However, because the typical tile floor contains dozens of feet of grout in length, the chore is tedious at best and normally requires constant kneeling.

One disposable patented device which addresses this issue of more conveniently applying grout sealant is disclosed in U.S. Pat. No. 5,302,043 to Velliquette teaching a rotatable striper wheel made of absorbent material which is automatically saturated from gravity fed sealant held within a squeeze bottle having an apertured opening positioned directly against the outer surface of the striper wheel.

Another currently marketed disposable grout sealant applicator also includes a squeezable bottle for containing a quantity of sealant and an end cap having a dispenser which is activated by depressing downwardly against the grout. However, this device is hand held requiring a kneeling position and containing only a small quantity of sealant and having a dispenser tip which quickly wears and becomes inoperative.

The present invention provides a grout sealant applicator which holds a very large quantity of sealant within its tubular handle and includes a valve connected at one end of the handle for regulating sealant flow which discharges from a nozzle having a small longitudinal bore therethrough. Being gravity fed, the device is economical to manufacture and provides sealant flow regulation as desired and use of the applicator from a sitting or standing position without the need for kneeling. An end cap optionally disposed at the other end of the handle includes a small vent hole which may be easily closed by finger or thumb pressure to momentarily stop or to substantially slow the sealant discharge rate as when lifting the nozzle from the grout. Preferably contoured to a standard concave configuration of grout, the distal end of the replaceable nozzle being similarly shaped, easily slides along the surface of the grout and is properly centered for sealant discharge. Being easily cleanable, the present invention is highly reusable.

BRIEF SUMMARY OF THE INVENTION

This invention is directed to a grout sealant applicator for holding a quantity of low viscosity liquid grout sealant and for controlling the uniform rate of dispensing the sealant into the groove of the grout of a tile floor. The applicator includes an elongated tubular handle which is fillable from one end with sealant and a sealant flow regulating valve at the other end of the handle. A nozzle is connected to the valve so that sealant flows by gravity feed from the handle when positioned somewhat uprightly, through the valve and a small longitudinal bore longitudinally within the nozzle. The handle is of sufficient length to hold a large quantity of sealant to minimize refills and to permit the hand grasping and manipulation of the upper end thereof to cause the distal end of the nozzle to manually slide within the grooves formed by the grout and without the need for stooping or kneeling. Sealant flow regulation is also controlled by providing a removable end cap at the upper in use end of the handle having a vent hole which may be closed by a finger or thumb of the user to prevent air from entering the handle. A tubular handle extension, transparency of the handle for sealant level viewing, and a shaped nozzle distal end conforming generally to the concave grout are also provided.

It is therefore an object of this invention to provide a time-saving grout sealant applicator which holds a substantial quantity of a low viscosity liquid grout sealant thus minimizing refills.

It is another object of this invention to provide a grout sealant applicator which depends only upon gravity flow for its dispensing of low viscosity liquid sealant atop grout in floor tile.

It is yet another object of this invention to provide a grout sealant applicator which includes a discharge nozzle configured at its distal end for sliding contact over the grout by mating engagement against the concave grout for centering and alignment purposes.

It is still another object of this invention to provide a grout sealant applicator having a transparent handle for viewing of the liquid sealant level remaining therein.

It is still another object of this invention to provide a grout sealant applicator which is useable from either a standing or a sitting position without the need for kneeling.

It is still another object of this invention to provide a grout sealant applicator having accurate sealant flow regulation means which facilitates uniform dispensing of sealant at a wide range of sealant concentrations.

It is still a further object of this invention to provide a grout sealant applicator which is easily cleanable for reuse and includes a wear resistant, yet replaceable, discharge nozzle.

In accordance with these and other objects which will become apparent hereinafter, the instant invention will now be described with reference to the accompanying drawings.

DETAILED DESCRIPTION OF THE INVENTION

Figure 1:
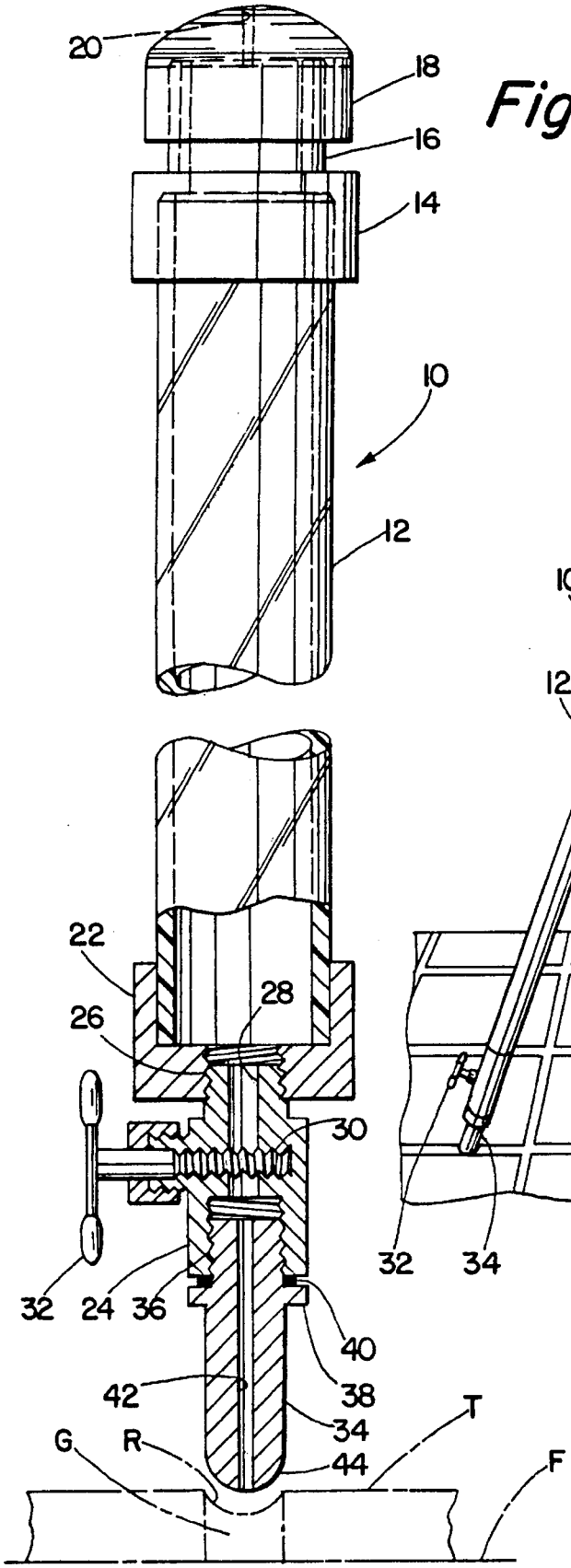
FIG. 1 is a side elevation partially broken view of one embodiment of the invention.
Figure 2:
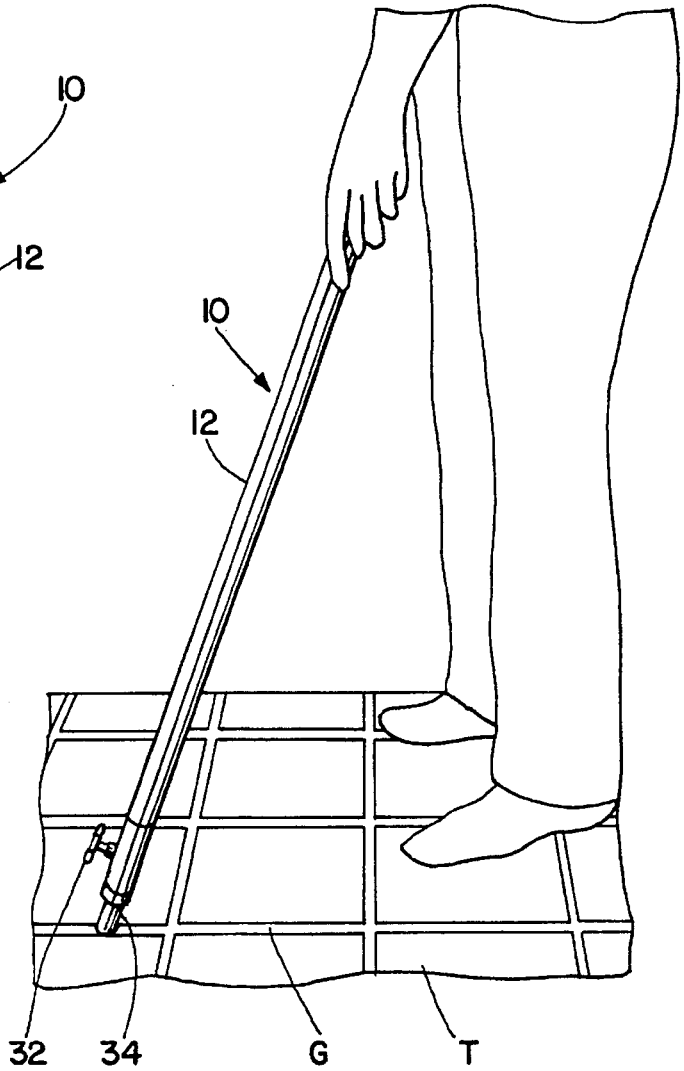
FIG. 2 is a pictorial view of the invention of Figure in use.

Referring now to the drawings, and particularly to FIGS. 1 and 2, one embodiment of the invention is shown generally at numeral 10 and includes a transparent plastic tubular handle 12 having a coupling 14 connected to a first end thereof. The coupling 14 includes external threads 16 which threadably engage into a removable end cap 18. The end cap 18 includes a vent hole 20 centrally positioned on its upper surface, the function of which will be described herebelow.

Another coupling 22 is connected at the opposite end of handle 12 having internal threads at 26 for threadably receiving the male threaded end of a valve 24. The valve 24 includes a longitudinal passage 28 therethrough and a threaded closure shaft or stem 30, the position of which is regulated by the rotation of valve handle 32. By this arrangement, low viscosity sealant which is poured into the handle 12 after the removal of end cap 18 passes through passage 28 for downward discharge from the valve 24 when the valve stem 30 is rotated to open passage 28 as desired.

A replaceable nozzle 34 formed of wear-resistant metal or plastic having a male threaded end is threadably engaged into the other outlet end of the valve 24 at 36. The nozzle 34 includes a longitudinal bore 42 formed therethrough having a relatively small diameter so as to restrict the flow of the low viscosity sealant. The preferred diameter for this bore 42 is 5/64". The nozzle 34 is sealably engaged by threads 36 into valve 24 by rubber O-ring 40 between the outlet end of valve 24 and flange 38.

The distal end 44 of nozzle 34 is semi-spherical so as to closely mate with a common concave radiused shape R of grout G which is formed of a cementuous material between adjacent tiles T which are adhered to the substrate F prior to the placing and hardening of the grout G. The semi-spherical distal end 44 of nozzle 34 thus facilitates the rapid easy sliding thereof along rows of grout G as seen in FIG. 2. By this arrangement, the spherical distal end 44 automatically properly centers the nozzle 34 within the radiused surface R of grout G.

Several features of the present invention permit regulation of the flow of the low viscosity sealant to afford consistency and desired level of sealant saturation. Obviously, the most important means for sealant flow adjustment and termination is by valve 24 by the suitable rotation adjustment of valve handle 32 as previously described. Another means for sealant flow regulation, particularly on an intermittent basis as when the device is momentarily lifted from the grout, is by applying finger pressure to cover vent 20. By preventing air from entering into the thus sealed interior of handle 12, sealant flow through passageway 28 of valve 24 is momentarily inhibited and/or otherwise substantially reduced.

Figure 3:
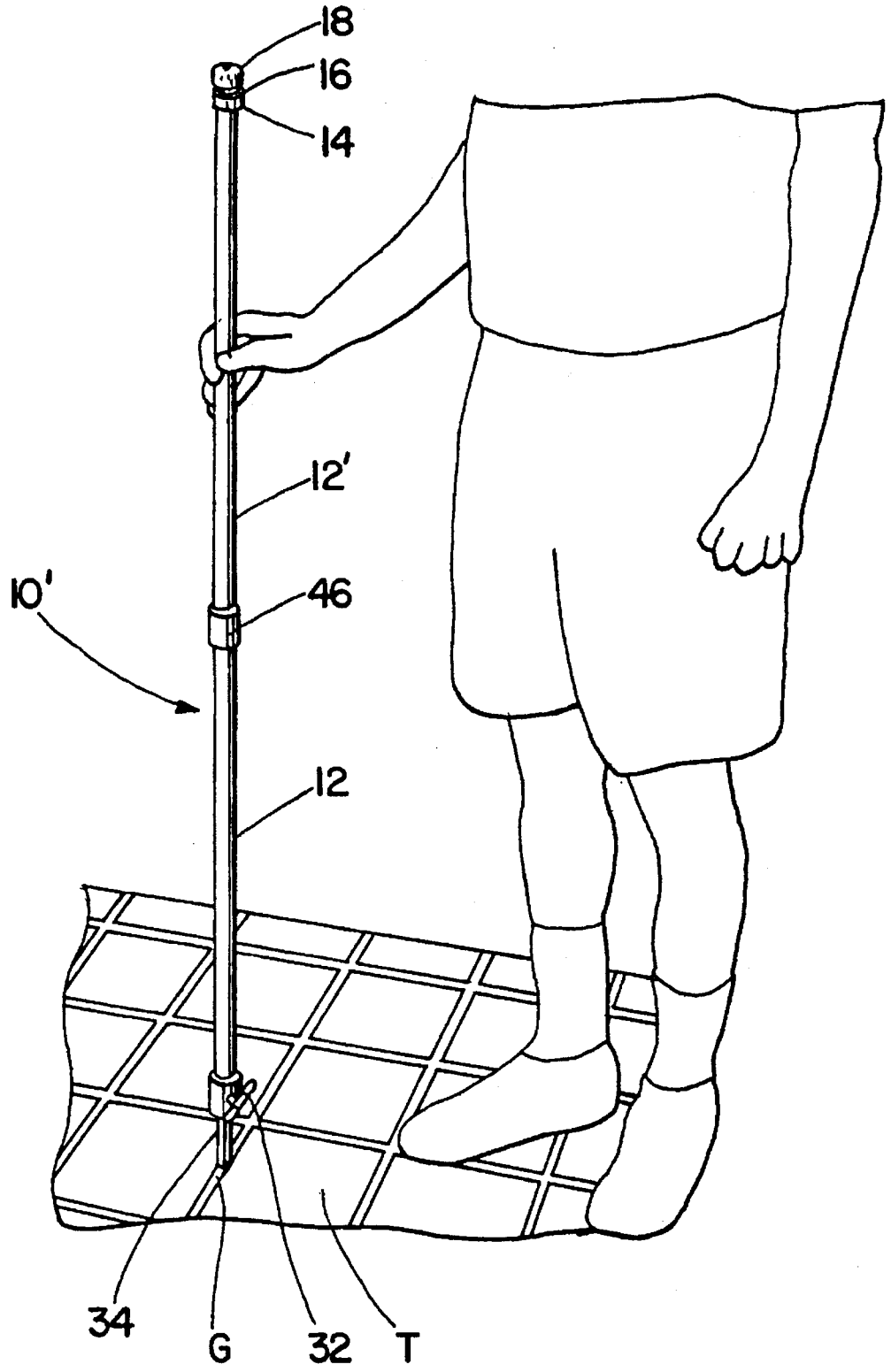
FIG. 3 is a pictorial view of another embodiment of the invention having a handle extension in use.

Yet a third means for sealant flow regulation in the preferred embodiment is by the selective angular positioning of the device 10 as shown compared between FIGS. 2 and 3. The longitudinal bore 42 of nozzle 34 exits centrally of the spherical distal end 44. When the device 10 is held in almost upright fashion with respect to the grout G as in FIG. 3, the longitudinal bore 42 is somewhat restricted. However, when the device 10 is tipped as in FIG. 2, direct contact of the lower end of the longitudinal bore 42 with the grout surface R is eliminated, allowing liquid sealant to flow more freely into the groove R.

Referring now to FIG. 3, an alternate embodiment of the invention is there shown at numeral 10' and includes two elongated tubular transparent plastic members 12 and 12' interconnected in coaxial fashion by coupling 46. A removable end cap 18 threadably engaged onto coupling 14 as previously described is fitted onto the upper end of handle extension 12'. In this embodiment 10', the same valve 34 with flow regulating member 32 as previously described is also provided. The embodiment 10' thus affords greater sealant storage and use while in a standing position.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A grout sealant applicator for holding a quantity of low viscosity liquid grout sealant and for dispensing the sealant into a groove defined by grout between floor tile, comprising:

an elongated tubular handle having a first and second end thereof;

said handle first end is open for receiving sealant poured into said handle when said first end is elevated;

a sealant metering means connected to said handle second end for manually regulating and stopping the gravity flow of sealant from said handle second end downwardly out from an outlet of said sealant metering means when said handle first end is elevated;

a nozzle means having a distal end and longitudinal bore therethrough and connected to said metering means outlet for sliding said distal end along and in contact with the groove and for depositing sealant at a flow rate regulated by said metering means into the groove from a supply of sealant in said handle when said handle first end is elevated by hand hold adjacent to said handle first end; and said handle is formed of transparent plastic for viewing the level of sealant stored within the handle.

2. A grout sealant applicator for holding a quantity of low viscosity liquid grout sealant and for dispensing the sealant into a groove defined by grout between floor tile, comprising:

an elongated tubular handle having a first and second end thereof;

said handle first end is open for receiving sealant poured into said handle when said first end is elevated;

a sealant metering means connected to said handle second end for manually regulating and stopping the gravity flow of sealant from said handle second end downwardly out from an outlet of said sealant metering means when said handle first end is elevated;

a nozzle means having a distal end and longitudinal bore therethrough and connected to said metering means outlet for sliding said distal end along and in contact with the groove and for depositing sealant at a flow rate regulated by said metering means into the groove from a supply of sealant in said handle when said handle first end is elevated by hand hold adjacent to said handle first end;

a removable end cap connected to said handle first end and having a small vent hole formed centrally therethrough; and said vent hole sized to be closed by finger or thumb pressure thereover to prevent air from passing through said vent hole into said handle whereby the rate of sealant flowing through said nozzle from within said handle is substantially decreased or momentarily stopped.

3. A grout sealant applicator according to in claim 1, further comprising:

an elongated tubular handle extension having a first and second end thereof;

said handle extension first end having a removable end cap connected thereto;

said end cap having a small vent hole formed centrally therethrough;

means for connecting said handle extension second end coaxially to said handle first end;

said vent hole sized to be closed by finger or thumb pressure thereover to prevent air from passing through said vent hole into said handle whereby the rate of sealant flowing through said nozzle from within said handle is substantially decreased or momentarily stopped.

4. A grout sealant applicator according to in claim 1, wherein:

said distal end is shaped to substantially mate within and be centered by, the concaved surface of the grout.

5. A grout sealant applicator for holding a quantity of low viscosity liquid grout sealant and for dispensing the sealant into a groove defined by grout between floor tile, comprising:

an elongated tubular handle having a first and second end thereof;

said handle first end is open for receiving sealant poured into said handle when said first end is elevated;

a sealant metering means connected to said handle second end for manually regulating and stopping the gravity flow of sealant from said handle second end downwardly out from an outlet of said sealant metering means when said handle first end is elevated;

a nozzle means having a distal end and longitudinal bore therethrough and connected to said metering means outlet for sliding said distal end along and in contact with the groove and for depositing sealant at a flow rate regulated by said metering means into the groove from a supply of sealant in said handle when said handle first end is elevated by hand hold adjacent to said handle first end;

said nozzle means is removably connected to said metering means;

said distal end of the nozzle means is semi-spherical of radius to mate with the concave radiused shape of grout; and said semi-spherical radius size is determined by the radius of the grout.

6. A grout sealant applicator, according to claim 1, wherein said metering means for manually regulating and stopping the gravity flow of sealant is a valve.

7. A grout sealant applicator, according to claim 5, further comprising:

an elongated tubular handle extension having a first and second end;

said handle extension first end having a removable end cap connected thereto;

said end cap having a small vent hole formed centrally therethrough;

means for connecting said handle extension second end coaxially to said handle first end; and said vent hole sized to be closed by finger or thumb pressure thereover to prevent air from passing through said vent hole into said handle whereby the rate of sealant flowing through said nozzle from within said handle is substantially decreased or momentarily stopped.

8. A grout sealant applicator, according to claim 2, wherein:

said nozzle means is removably connected to said metering means;

said distal end of the nozzle means is semi-spherical of radius to mate with the concave radiused shape of grout; and said semi-spherical radius size is determined by the radius of the grout.

9. A grout sealant applicator, according to claim 2, wherein said distal end of the nozzle means is shaped to substantially mate with and be centered by, the concave surface of the grout.

10. A kit for a grout sealant applicator, comprising:

an elongated tubular handle having a first and second end thereof;

said handle first end is open for receiving sealant poured into said handle when said first end is elevated;

a sealant metering means connected to said handle second end for manually regulating and stopping the gravity flow of sealant from said handle second end downwardly out from an outlet of said sealant metering means when said handle first end is elevated;

a nozzle means having a distal end and longitudinal bore therethrough and connected to said metering means outlet for sliding said distal end along and in contact with the groove and for depositing sealant at a flow rate regulated by said metering means into the groove from a supply of sealant in said handle when said handle first end is elevated by hand hold adjacent to said handle first end;

said handle is formed of transparent plastic for viewing the level of sealant stored within the handle; and said distal end is shaped to substantially mate with and be centered by, the concave surface of the grout.

11. A kit for a grout sealant applicator, according to claim 10, further comprising:

a removable end cap connected to said handle first end and having a small vent hole formed centrally therethrough; and said vent hole sized to be closed by finger or thumb pressure thereover to prevent air from passing through said vent hole into said handle whereby the rate of sealant flowing through said nozzle from within said handle is substantially decreased or momentarily stopped.

12. A kit for a grout sealant applicator, according to claim 10, further comprising:

an elongated tubular handle extension having a first and second end;

said handle extension first end having a removable end cap connected thereto;

said end cap having a small vent hole formed centrally therethrough;

means for connecting said handle extension second end coaxially to said handle first end; and said vent hole sized to be closed by finger or thumb pressure thereover to the rate of sealant flowing through said nozzle from within said handle whereby the rate of sealant flowing through said nozzle from within said handle is substantially decreased or momentarily stopped.

* * * * *